US005963998A

United States Patent [19]

Carew et al.

[11] Patent Number: 5,963,998

[45] Date of Patent: Oct. 12, 1999

[54] RECESSED SLEEPING SURFACE

[75] Inventors: James M Carew; Joann Williams Carew, both of Brattleboro, Vt.

[73] Assignee: Racing Strollers, Inc., Yakima, Wash.

[21] Appl. No.: 08/701,201

[22] Filed: Aug. 21, 1996

Related U.S. Application Data

[63] Continuation of application No. 08/336,007, Nov. 8, 1994, abandoned.

[51] Int. Cl.[6] ..... A47C 20/02

[52] U.S. Cl. ..... 5/655; 5/722; 5/723; 5/732

[58] Field of Search ..... 5/655, 900, 424, 5/425, 485, 727, 722, 723, 732

[56] References Cited

U.S. PATENT DOCUMENTS

| | | | |
|---|---|---|---|
| D. 288,636 | 3/1987 | Molaren | 5/425 |
| 1,473,370 | 11/1923 | Heller | 5/424 |
| 3,321,779 | 5/1967 | Kaufman et al. | 5/93 |
| 3,639,927 | 2/1972 | Munch | 5/91 |
| 3,742,528 | 7/1973 | Munch | 5/91 |
| 3,761,975 | 10/1973 | Personett | 5/348 |
| 4,081,868 | 4/1978 | Hull | 5/425 |
| 4,190,916 | 3/1980 | McMullan | 5/451 |
| 4,234,977 | 11/1980 | Snow | 5/655 |
| 4,286,344 | 9/1981 | Ikeda | 5/434 |
| 4,449,261 | 5/1984 | Maghusson | 5/727 |
| 4,517,693 | 5/1985 | Viesturs | 5/485 |
| 4,607,402 | 8/1986 | Pollard | 5/425 |
| 4,628,557 | 12/1986 | Murphy | 5/446 |
| 4,672,698 | 6/1987 | Sands | 5/424 |
| 4,754,509 | 7/1988 | Pollard | 5/425 |
| 4,788,726 | 12/1988 | Rafalko | 5/93 R |
| 4,872,228 | 10/1989 | Bishop | 5/425 |
| 4,934,002 | 6/1990 | Watanabe | 5/425 |
| 4,953,246 | 9/1990 | Matthews | 5/424 |
| 4,980,940 | 1/1991 | Isshiki | 5/425 |
| 4,999,863 | 3/1991 | Kane | 5/98.1 |
| 5,010,611 | 4/1991 | Mallet | 5/497 |
| 5,044,027 | 9/1991 | Moon | 5/448 |
| 5,103,514 | 4/1992 | Leach | 5/417 |
| 5,107,558 | 4/1992 | Luck | 5/464 |
| 5,261,133 | 11/1993 | Wilkerson | 5/655 |
| 5,343,575 | 9/1994 | Cartwright | 5/900 |
| 5,359,740 | 11/1994 | Markley et al. | 5/425 |
| 5,455,973 | 10/1995 | Brumfield et al. | 5/424 |

FOREIGN PATENT DOCUMENTS

| | | | |
|---|---|---|---|
| 2211401 | 7/1989 | United Kingdom | 5/424 |

*Primary Examiner*—Michael F. Trettel
*Assistant Examiner*—Fred Conley
*Attorney, Agent, or Firm*—Seed and Berry LLP

[57] ABSTRACT

A mattress with permanently attached bumper side walls which form a recess for protecting children at risk of falling off the bed. Also provided is an inset which transforms the mattress to a common flat sleeping surface.

10 Claims, 2 Drawing Sheets

RECESSED SLEEPING SURFACE

This application is a continuation (file wrapper continuing application (FWC)) of prior U.S. patent application No. 08/336,007, filed Nov. 8, 1994, now abandoned.

BACKGROUND

The present invention is a mattress to be used as a bed or a part thereof or with a crib. More particularly it involves a mattress and inset combination that provides protection from roll outs or bumps for people, particularly children, while they are sleeping on the mattress with the inset removed. With the inset not removed, the mattress has the appearance of a common flat mattress.

Protecting people from rolling out of bed while they sleep, be it in a crib, on a bed or other sleeping surface, usually involves the use of some type of accessory to go with the basic mattress or sleeping surface. Side guard pads and rail guards are two of the most common devices used and may be viewed anywhere children's bedding is sold. Also available are pad rings that are placed on top of a mattress. These methods have problems which are solved by our mattress.

Pad type side guards and rings usually tie to rail side guards or to crib or bassinet sides. They are cumbersome and in need of continual retying or adjustment. Frequently, after regular use, they sag, tear or loose their shape. A common fear is that children can get caught in them and their accessories and be at risk for injury and possible strangulation.

Rail guards, also known as side rails, are difficult to put into place because they must attach to a bed frame or have a part that must be placed between mattresses. The support bars between mattresses can tear sheets and wear holes in the mattresses and covers. The rails are also inconvenient for the person who has to make the bed.

Side rails are often made of hard materials and are difficult to keep in place as well as maneuver. They are painful to roll into, and the spaces between the rails and the bed are seen by many customers as being sufficient to entrap a child.

Recent news reports have revealed the injury risk with rails and, in some cases, given notice of recalls of them to prevent injury and/or fatality.

Numerous inventions have emphasized problems in protecting against rolling out of bed. Pollard, U.S. Pat. No. 4,754,509, has suggested a sheet fitted with attachable foam insets which is difficult to launder. Kaufman and Tabler, U.S. Pat. No. 3,321,779, invented a crib mattress with attached wing-like side pads that are tied to existing rails, but present the same poor safety image as side pads. Ikeda, U.S. Pat. No. 4,286,344, suggests a mattress with built-in or attached side ridges to help prevent a person from rolling off a bed, but the resulting bed cannot be used as a normal flat bed for a sleeper not at risk from a fall.

All previous art teaches adding something to a bed, and then storing that something if the bed is to be used normally; or else dedicating the bed to always be used with bumper features. The present invention teaches the practicality of simply removing an inset from a normal looking and feeling mattress, making a mattress with bumpers.

SUMMARY OF THE INVENTION

The present invention is a mattress with two major component parts which can be separated at will by the owner or user. The smaller part, the inset, fits into a recess in the surface of the larger part, referred to herein as the base. With the smaller part removed, the bottom of the recess becomes a flat sleeping surface, and the interior sides of the recess are padded and act as bumpers to stop a person from rolling off the sleeping surface.

If the mattress is to be used by someone not at risk from rolling off the mattress, the inset may be placed back into the recess to make a mattress that looks and feels like a common flat mattress.

In view of the above discussion it is an object of this invention to provide a mattress which uniquely contains bed restraints as a permanent part of the mattress.

Also, it is an object to provide a design that can be sized lo fit any bed frame or structure.

It is another object of this invention to make a mattress that is convertible between a bumper mattress and a typical sleeping mattress once the built-in security is not needed.

It is also an object of this invention to provide a mattress for beds meeting the needs of a child through the various stages of development from infancy to adulthood.

These and other objects are attained in our mattress invention which is a mattress of any size that has a recessed area for the purpose of safe sleeping. Additionally, for purposes of conversion, a fitted inset can be placed within the recess in order to be used as a typical adult mattress.

DESCRIPTION OF THE PREFERRED EMBODIMENT

A mattress may be geometrically described as a rectangular solid with a top planar surface operationally horizontally disposed with a coextensive parallel bottom planar surface separated from the top surface by several inches of soft, pliant or shock absorbing materials.

Figure 1:
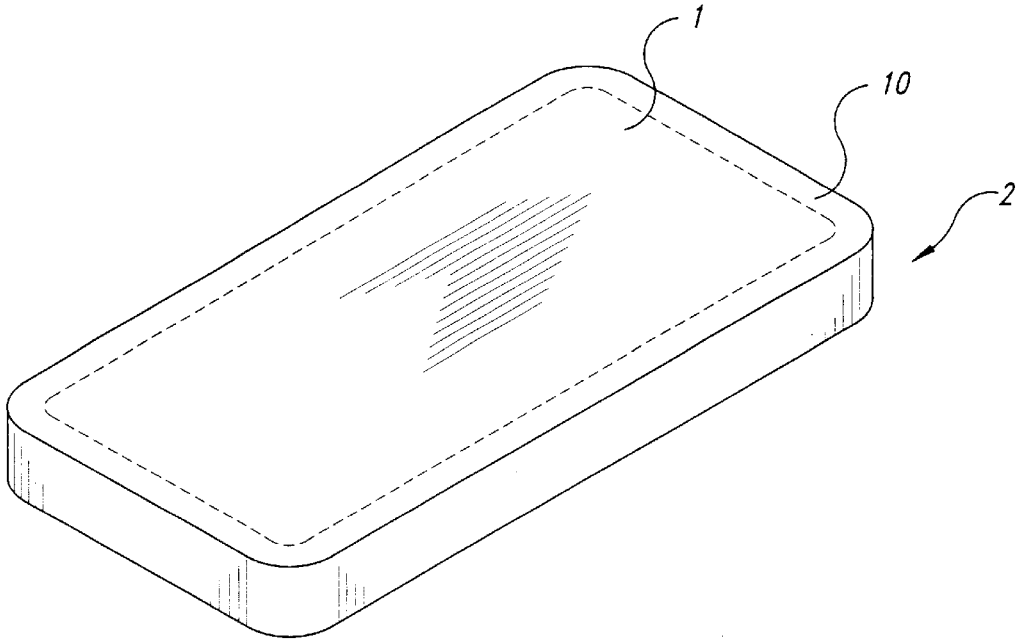
FIG. 1 is a pictorial of the mattress with inset not removed.
Figure 2:
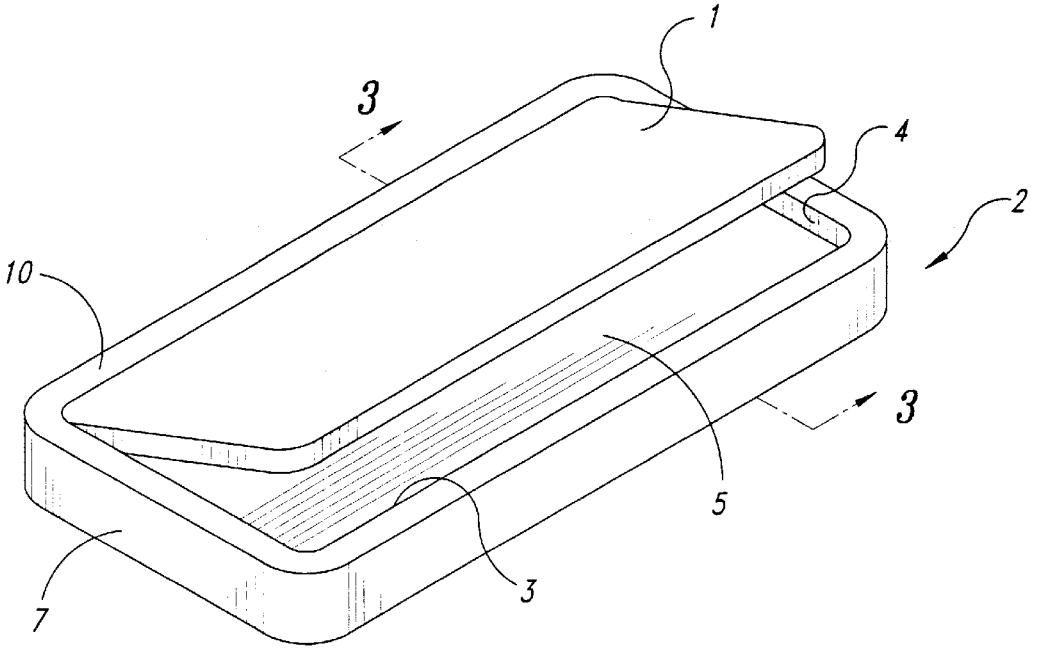
FIG. 2 is a pictorial representation of the mattress with the rectangular inset partially removed and revealing the sleeping recess and bumper sides.
Figure 3:
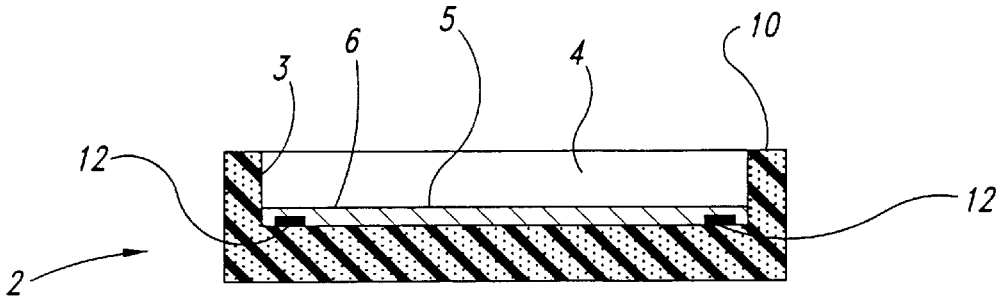
FIG. 3 shows a cross sectional view through the base without the inset.
Figure 4:
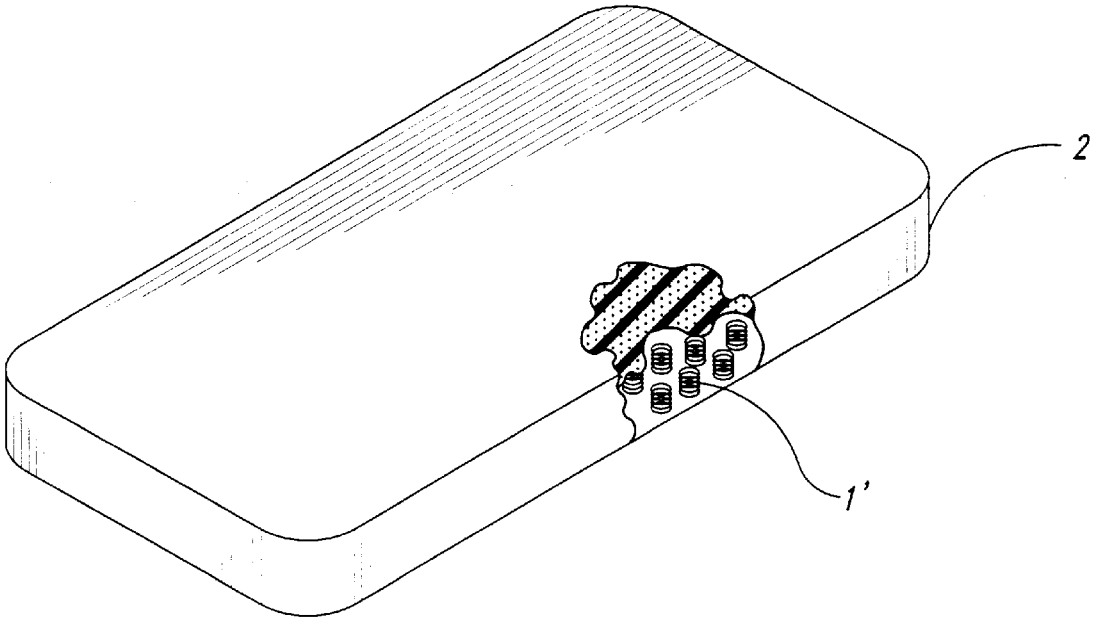
FIG. 4 shows a second preferred embodiment with the inset providing additional support when the base is inverted for a flat sleeping surface.

As depicted in FIG. 1, the present invention has a common mattress shape when an inset 1 and base mattress 2 are combined. As the inset 1 is raised out of the top planar surface 10 of the base mattress 2, as in FIG. 2, and eventually completely removed and set aside, the upwardly extended side walls 3 and end walls 4 are revealed as part of the base mattress 2. Said side walls 3 and end walls 4 are permanently connected to and part of the base mattress 2 and being continuous about the outer edge of the base, together with recessed surface 5, can enclose the inset 1.

The base mattress 2 is preferably made of a foamed material such as foam rubber or foam polyurethane, but any pliant material or combination of materials can be used including an impervious film filled with fluid. Molding the mattress with foam allows possible use of varying durometers or parts molded in as options for different models. To provide an appealing appearance and protect the mattress, a cloth fabric 7 covers all the exposed surfaces of the base mattress 2 and the inset 1.

The inset 1 is preferably also made of foamed plastic or rubber and may be the piece cut from a foam block to make the base mattress 2.

A conventional construction of springs and padding may be used as an alternate preferred material for the inset 1'. With the alternate preferred construction, the combined base mattress 2 and inset 1' would be inverted, with the inset 1' under the base mattress 2, to provide a normal adult flat sleeping surface.

As additional protection for the mattress, a pad 6 may be placed on the recessed surface 5 or may be hitched by various known means including hook and loop fasteners 12. Said pad 6 may include a comfortable soft cloth or impervious material to protect the base mattress 2 from wetness.

A further optional use for the base mattress 2 could be as a play pool or wash basin if the liner is impervious to fluids.

We claim:

1. A method for using a dual sleeping surface mattress constructed to provide one sleeping surface which restricts the movement of an individual sleeping thereon, comprising:

a) providing a mattress body and a mattress inset, said mattress body being usable with and without said mattress inset, said mattress body being reversible between upward and downward facing orientations, with a pair of opposing, laterally spaced apart, outward side walls, and a pair of opposing, laterally spaced apart, outward end walls, said outward side walls and end walls defining a periphery of said mattress, said mattress body having:

a flat and horizontal first body surface facing upward when said mattress body is in said upward facing orientation and extending about said periphery of said mattress body along said outward side walls and end walls of said mattress body, said first horizontal body surface constructed of a soft cushioning material suitable to receive the sleeping individual thereon;

a flat and horizontal second body surface opposite said first horizontal body surface and facing downward when said mattress body is in said upward facing orientation and upward when said mattress body is in said downward facing orientation, said second horizontal body surface constructed of a soft cushioning material suitable to receive the sleeping individual thereon and extending substantially fully between said outward side walls and end walls of said mattress body;

a pair of opposing, laterally spaced apart, inward side walls extending downward into said mattress body from said first horizontal body surface when said mattress body is in said upward facing orientation, said inward side walls positioned inward from and substantially parallel to said outward side walls to form a pair of spaced apart peripheral barriers extending substantially the fall length of said mattress body, said inward side walls being a pliant and soft material suitable to cushion the sleeping individual;

a pair of opposing, laterally spaced apart, inward end walls, extending downward into said mattress body from said first horizontal body surface when said mattress body is in said upward facing orientation, and transverse to said inward side walls, said inward end walls positioned inward from and substantially parallel to said outward end walls to form a pair of spaced apart peripheral barriers extending substantially the full width of said mattress body, said inward end walls being a pliant and soft material suitable to cushion the sleeping individual; and an upward facing, externally exposed flat and horizontal first sleeping surface constructed of a soft cushioning material suitable to receive the sleeping individual thereon, recessed downward from said first horizontal body surface when said mattress body is in said upward facing orientation and defined by said inward side walls and said inward end walls, with said inward side walls, said inward end walls, and said recessed first sleeping surface defining an unobstructed, upwardly open recess in said mattress body having an uncovered upward opening providing unobstructed access to said recessed first sleeping surface from above when said mattress body is used in said upward facing orientation without said mattress inset, said recessed first sleeping surface being of sufficient surface area to accommodate the fall body of the sleeping individual thereon and said inward side walls and said inward end walls being of sufficient height to restrict movement of the sleeping individual on said recessed first sleeping surface beyond said periphery of said mattress body, said pairs of peripheral barriers and said recessed first sleeping surface having a construction without sufficiently sized opening therebetween to prevent the sleeping individual on said recessed first sleeping surface from extending an arm, leg or head between said barriers and said recessed first sleeping surface; and said mattress inset being selectively and removably positionable within and out of said recess and sized to substantially fill said recess when used with said mattress body by being positioned within said recess, said mattress inset having:

a first flat and horizontal inset surface constructed of a soft cushioning material suitable to receive the sleeping individual thereon and sized to extend substantially fully between said inward side walls and end walls when said mattress inset is positioned within said recess; and a second horizontal inset surface sized to be positionable adjacent to said recessed first sleeping surface when in position within said recess, said first and second horizontal inset surfaces being spaced apart by a distance such that when said mattress inset is positioned within said recess said first horizontal inset surface is substantially coplanar and contiguous with said first horizontal body surface to define together a combined flat surface extending substantially to said periphery of said mattress body, with said combined flat surface when said mattress body is in said upward facing orientation and said second horizontal body surface when said mattress body is in said downward facing orientation defining an exposed flat and horizontal second sleeping surface larger than said recessed first sleeping surface for receiving the sleeping individual thereon when said inset is positioned within said recess;

b) placing said mattress body in said upward facing orientation without said mattress inset in said recess;

c) moving the individual downward through said upward opening of said recess from above and into said recess toward said recessed first sleeping surface with said mattress body in said upward facing orientation without said mattress inset in said recess and with said upward opening uncovered; and d) after moving the individual through said upward opening of said recess, placing the individual on said recessed first sleeping surface in a position for sleeping.

2. The method of claim 1, further comprising:

lifting the individual from said recessed sleeping surface;

moving the individual upward through said upward opening of said recess and out of said recess;

placing said mattress inset within said recess with said second horizontal inset surface positioned adjacent to said recessed first sleeping surface;

selecting one of said upward facing and downward facing orientations for said mattress body, and if not in said selected orientation, moving said mattress body to said selected orientation; and placing the individual in a position for sleeping on said combined flat surface if said selected orientation is with said mattress body in said upward facing orientation, and on said second horizontal body surface if said selected orientation is with said mattress body in said downward facing orientation.

3. A method for using a dual sleeping surface mattress, constructed to provide one sleeping surface which restricts the movement of an individual sleeping thereon, comprising:

a) providing a mattress body and a mattress inset, said mattress body being usable with and without said mattress inset, said mattress body being reversible between upward and downward facing orientations, with a pair of opposing, laterally spaced apart, outward side walls, and a pair of opposing, laterally spaced apart, outward end walls, said outward side walls and end walls defining a periphery of said mattress, said mattress body having:

a first horizontal body surface facing upward when said mattress body is in said upward facing orientation and extending about said periphery of said mattress body along said outward side walls and end walls of said mattress body;

a flat and horizontal second body surface opposite said first horizontal body surface and facing downward when said mattress body is in said upward facing orientation and upward when said mattress body is in said downward facing orientation, said second horizontal body surface constructed of a soft cushioning material suitable to receive the sleeping individual thereon and extending substantially fully between said outward side walls and end walls of said mattress body;

a pair of opposing, laterally spaced apart, inward side walls extending downward into said mattress body from said first horizontal body surface when said mattress body is in said upward facing orientation, said inward side walls positioned inward from and substantially parallel to said outward side walls to form a peripheral barrier extending substantially the full length of said mattress body;

a pair of opposing, laterally spaced apart, inward end walls, extending downward into said mattress body from said first horizontal body surface when said mattress body is in said upward facing orientation, and transverse to said inward side walls, said inward end walls positioned inward from and substantially parallel to said outward end walls to form a peripheral barrier extending substantially the full width of said mattress body; and an upwardly facing, externally exposed first sleeping surface constructed of a soft cushioning material suitable to receive the sleeping individual thereon, recessed downward from said first horizontal body surface when said mattress body is in said upward facing orientation and defined by said inward side walls and said inward end walls, with said inward side walls, said inward end walls, and said recessed first sleeping surface defining an unobstructed, upwardly open recess in said mattress body having an uncovered upward opening providing unobstructed access to said recessed first sleeping surface from above when said mattress body is used in said upward facing orientation without said mattress inset, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body; and said mattress inset being selectively and removably positionable within and out of said recess and sized to substantially fill said recess when used with said mattress body by being positioned within said recess, said mattress inset having:

a first horizontal inset surface; and a second horizontal inset surface sized to be positionable adjacent to said recessed first sleeping surface when in position within said recess, said first and second horizontal inset surfaces being spaced apart by a distance such that when said mattress inset is positioned within said recess said first horizontal inset surface is substantially coplanar with said first horizontal body surface to define together a flat surface extending substantially to said periphery of said mattress body, with said second horizontal body surface when said mattress body is in said downward facing orientation defining an exposed second sleeping surface larger than said recessed first sleeping surface for receiving the sleeping individual thereon when said mattress inset is positioned within said recess;

b) placing said mattress body in said upward facing orientation without said mattress inset in said recess;

c) moving the individual downward through said upward opening of said recess from above and into said recess toward said recessed first sleeping surface with said mattress body in said upward facing orientation without said mattress inset in said recess and with said upward opening uncovered; and d) after moving the individual through said upward opening of said recess, placing the individual on said recessed first sleeping surface in a position for sleeping.

4. The method of claim 3, further comprising:

lifting the individual from said recessed sleeping surface;

moving the individual upward through said upward opening of said recess and out of said recess;

placing said mattress inset within said recess with said second horizontal inset surface positioned adjacent to said recessed first sleeping surface;

selecting one of said upward facing and downward facing orientations for said mattress body, and if not in said selected orientation, moving said mattress body to said selected orientation; and placing the individual in a position for sleeping on said first horizontal inset surface if said selected orientation is with said mattress body in said upward facing orientation, and on said second horizontal body surface if said selected orientation is with said mattress body in said downward facing orientation.

5. A method for using a dual sleeping surface mattress, constructed to provide one sleeping surface which restricts the movement of an individual sleeping thereon, comprising:

a) a mattress body and a mattress inset, said mattress body being usable with and without said mattress inset, said mattress body being positionable in upward and downward facing orientations, with a pair of opposing, laterally spaced apart, outward side walls, and a pair of opposing, laterally spaced apart, outward end walls, said outward side walls and end walls defining a periphery of said mattress, said mattress body having:

a first horizontal body surface facing upward when said mattress body is in said upward facing orientation and extending about said periphery of said mattress body along said outward side walls and end walls of said mattress body;

a flat and horizontal second body surface opposite said first horizontal body surface and facing downward when said mattress body is in said upward facing orientation and upward when said mattress body is in said downward facing orientation, said second horizontal body surface constructed of a soft cushioning material suitable to receive the sleeping individual thereon and extending substantially fully between said outward side walls and end walls of said mattress body;

a pair of opposing, laterally spaced apart, inward side walls extending downward into said mattress body from said first horizontal body surface when said mattress body is in said upward facing orientation, said inward side walls positioned inward from said outward side walls to form a peripheral barrier extending substantially the fall length of said mattress body;

a pair of opposing, laterally spaced apart, inward end walls, extending downward into said mattress body from said first horizontal body surface when said mattress body is in said upward facing orientation, and transverse to said inward side walls, said inward end walls positioned inward from said outward end walls to form a peripheral barrier extending substantially the fall width of said mattress body; and an upwardly facing, externally exposed first sleeping surface constructed of a soft cushioning material suitable to receive the sleeping individual thereon, recessed downward from said first horizontal body surface when said mattress body is in said upward facing orientation and defined by said inward side walls and said inward end walls, with said inward side walls, said inward end walls, and said recessed first sleeping surface defining an unobstructed, upwardly open recess in said mattress body having an uncovered upward opening providing unobstructed access to said recessed first sleeping surface from above when said mattress body is used in said upward facing orientation without said mattress inset, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body; and said mattress inset being selectively and removably positionable within and out of said recess and sized to substantially fill said recess when used with said mattress body by being positioned within said recess, said mattress inset having:

a first horizontal inset surface; and a second horizontal inset surface sized to be positionable adjacent to said recessed first sleeping surface when in position within said recess, said first and second horizontal inset surfaces being spaced apart by a distance such that when said mattress inset is positioned within said recess said first horizontal inset surface is substantially coplanar with said first horizontal body surface to define together a flat surface extending substantially to said periphery of said mattress body, with at least one of said combined flat surface when said mattress body is in said upward facing orientation or said second horizontal body surface when said mattress body is in said downward facing orientation defining an exposed second sleeping surface larger than said recessed first sleeping surface for receiving the sleeping individual thereon when said mattress inset is positioned within said recess;

b) placing said mattress body in said upward facing orientation without said mattress inset in said recess;

c) moving the individual downward through said upward opening of said recess from above and into said recess toward said recessed first sleeping surface with said mattress body in said upward facing orientation without said mattress inset in said recess and with said upward opening uncovered; and d) after moving the individual through said upward opening of said recess, placing the individual on said recessed first sleeping surface in a position for sleeping.

6. The method of claim 5, farther comprising:

lifting the individual from said recessed sleeping surface;

moving the individual upward through said upward opening of said recess and out of said recess;

placing said mattress inset within said recess with said second horizontal inset surface positioned adjacent to said recessed first sleeping surface;

selecting one of said upward facing and downward facing orientations for said mattress body, and if not in said selected orientation, moving said mattress body to said selected orientation; and placing the individual in a position for sleeping on said exposed second sleeping surface.

7. A method for using a sleeping mattress, constructed to provide one sleeping surface which restricts the movement of an individual sleeping thereon, comprising:

(a) a mattress body and a mattress inset, said mattress body being usable with and without said mattress inset, said mattress body being positionable in an upward facing orientation, with a pair of opposing, laterally spaced apart, outward side walls, and a pair of opposing, laterally spaced apart, outward end walls, said outward side walls and end walls defining a periphery of said mattress and projecting upward when said mattress body is in said upward facing orientation, said mattress body having:

a first horizontal body surface facing upward when said mattress body is in said upward facing orientation and extending about said periphery of said mattress body along said outward side walls and end walls of said mattress body;

a second body surface opposite said first horizontal body surface and facing downward when said mattress body is in said upward facing orientation;

a pair of opposing, laterally spaced apart, inward side walls extending downward into said mattress body from said first horizontal body surface when said mattress body is in said upward facing orientation, said inward side walls positioned inward from said outward side walls to form a peripheral barrier extending substantially the full length of said mattress body;

a pair of opposing, laterally spaced apart, inward end walls, extending downward into said mattress body from said first horizontal body surface when said mattress body is in said upward facing orientation, said inward end walls positioned inward from said outward end walls to form a peripheral barrier extending substantially the full width of said mattress body; and an upwardly facing, externally exposed first sleeping surface constructed of a soft cushioning material suitable to receive the sleeping individual thereon, recessed downward from said first horizontal body surface when said mattress body is in said upward facing orientation and defined by said inward side walls and said inward end walls, with said inward side walls, said inward end walls, and said recessed first sleeping surface defining an unobstructed, upwardly open recess in said mattress body having an uncovered upward opening providing unobstructed access to said recessed first sleeping surface from above when said mattress body is used in said upward facing orientation without said mattress inset, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body; and said mattress inset being selectively and removably positionable within and out of said recess and sized to substantially fill said recess when used with said mattress body by being positioned within said recess, said mattress inset having:

a first horizontal inset surface; and a second horizontal inset surface sized to be positionable adjacent to said recessed first sleeping surface when in position within said recess, said first and second horizontal inset surfaces being spaced apart by a distance such that when said mattress inset is positioned within said recess said first horizontal inset surface is substantially coplanar with said first horizontal body surface to define together a flat surface extending substantially to said periphery of said mattress body;

b) positioning said mattress body in said upward facing orientation without said mattress inset in said recess;

c) moving the individual downward through said upward opening of said recess from above and into said recess toward said recessed first sleeping surface with said mattress body in said upward facing orientation without said mattress inset in said recess and with said upward opening uncovered; and d) after moving the individual through said upward opening of said recess, placing the individual on said recessed first sleeping surface in a position for sleeping.

8. The method of claim 7, further comprising:

lifting the individual from said recessed sleeping surface;

moving the individual upward through said upward opening of said recess and out of said recess;

placing said mattress inset within said recess with said second horizontal inset surface positioned adjacent to said recessed first sleeping surface;

selecting one of said upward facing and downward facing orientations for said mattress body, and if not in said selected orientation, moving said mattress body to said selected orientation; and next, placing the individual on said now upward facing one of said first horizontal inset surface and said second body surface.

9. A method for using a sleeping mattress, constructed to provide one sleeping surface which restricts the movement of an individual sleeping thereon, comprising:

a) a mattress body and a mattress inset, said mattress body being usable with and without said mattress inset, said mattress body being positionable in an upward facing orientation, with a pair of opposing, laterally spaced apart, outward side walls, and a pair of opposing, laterally spaced apart, outward end walls, said outward side walls and end walls defining a periphery of said mattress and projecting upward when said mattress body is in said upward facing orientation, said mattress body having:

a first body surface facing upward when said mattress body is in said upward facing orientation and extending about said periphery of said mattress body along said outward side walls and end walls of said mattress body;

a second body surface opposite said first body surface and facing downward when said mattress body is in said upward facing orientation;

a pair of opposing, laterally spaced apart, inward side walls extending downward into said mattress body from said first body surface when said mattress body is in said upward facing orientation, said inward side walls positioned inward from said outward side walls to form a peripheral barrier extending substantially the full length of said mattress body;

a pair of opposing, laterally spaced apart, inward end walls, extending downward into said mattress body from said first body surface when said mattress body is in said upward facing orientation, said inward end walls positioned inward from said outward end walls to form a peripheral barrier extending substantially the fall width of said mattress body; and an upwardly facing, externally exposed first sleeping surface constructed of a soft cushioning material suitable to receive the sleeping individual thereon, recessed downward from said first body surface when said mattress body is in said upward facing orientation and defined by said inward side walls and said inward end walls, with said inward side walls, said inward end walls, and said recessed first sleeping surface defining an unobstructed, upwardly open recess in said mattress body having an uncovered upward opening providing unobstructed access to said recessed first sleeping surface from above when said mattress body is used in said upward facing orientation without said mattress inset, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body; and said mattress inset being selectively and removably positionable within and out of said recess, said mattress inset having:

a first inset surface; and a second inset surface sized to be positionable adjacent to said recessed first sleeping surface when in position within said recess, said first and second inset surfaces being spaced apart by a distance such that when said mattress inset is positioned within said recess said mattress inset substantially fills said recess;

b) positioning said mattress body in said upward facing orientation without said mattress inset in said recess;

c) moving the individual downward through said upward opening of said recess from above and into said recess toward said recessed first sleeping surface with said mattress body in said upward facing orientation without said mattress inset in said recess and with said upward opening uncovered; and d) after moving the individual through said upward opening of said recess, placing the individual on said recessed first sleeping surface in a position for sleeping.

10. The method of claim 9, further comprising:

lifting the individual from said recessed sleeping surface;

moving the individual upward through said upward opening of said recess and out of said recess;

placing said mattress inset within said recess with said second inset surface positioned adjacent to said recessed first sleeping surface;

selecting one of said upward facing and downward facing orientations for said mattress body, and if not in said selected orientation, moving said mattress body to said selected orientation; and next, placing the individual on said now upward facing one of said first inset surface and said second body surface.

* * * * *